US006123206A

United States Patent [19]

Zaremba

[11] Patent Number: 6,123,206

[45] Date of Patent: Sep. 26, 2000

[54] REMOVABLE DISPLAY ATTACHMENT WITH WEDGELIKE RETAINERS FOR VERTICAL RIGID CYLINDRICAL SUPPORTS

[76] Inventor: George Julian Zaremba, 6630 N. Kostner, Lincolnwood, Ill. 60646

[21] Appl. No.: 08/855,307

[22] Filed: May 13, 1997

Related U.S. Application Data

[63] Continuation-in-part of application No. 08/587,009, Jan. 16, 1996, Pat. No. 5,715,954.

[51] Int. Cl.[7] ..... A47F 5/14

[52] U.S. Cl. ..... 211/107; 211/205; 211/133.4; 220/475; 108/147.13

[58] Field of Search ..... 211/107, 187, 211/133.1, 133.4, 188, 205, 189–190, 153, 186; 220/475, 23.83, 23.86; 108/144.11, 147.13, 164; 248/243, 244, 125.1, 219.3, 218.4, 220.21; 206/503

[56] References Cited

U.S. PATENT DOCUMENTS

| | | | |
|---|---|---|---|
| 2,883,066 | 4/1959 | Pratt | 211/133.1 |
| 2,951,593 | 9/1960 | Lake | 211/144 |
| 3,414,133 | 12/1968 | Guerri et al. | 211/107 |
| 3,642,263 | 2/1972 | Pine et al. | 220/23.83 |
| 3,674,229 | 7/1972 | Keeler, II | 211/187 |
| 3,675,598 | 7/1972 | Kesilman et al. | 108/144 |
| 3,757,705 | 9/1973 | Maslow | 108/144 |
| 4,117,629 | 10/1978 | Ekdahl | 211/107 |
| 4,138,953 | 2/1979 | Tashman | 108/144 |
| 4,262,439 | 4/1981 | Dinan et al. | 211/187 |
| 4,311,237 | 1/1982 | Hayes | 206/503 |
| 4,345,526 | 8/1982 | Streit | 108/111 |
| 4,467,927 | 8/1984 | Nathan | 211/153 |
| 4,574,709 | 3/1986 | Lackey | 108/111 |
| 4,589,351 | 5/1986 | Love | 108/144 |
| 4,627,543 | 12/1986 | Nicely | 211/187 |
| 4,629,077 | 12/1986 | Niblock | 211/187 |
| 4,678,089 | 7/1987 | Lang | 211/133.4 |
| 4,852,501 | 8/1989 | Olson et al. | 108/144.11 |
| 4,865,283 | 9/1989 | Parker | 248/159 |
| 5,183,167 | 2/1993 | Cheng | 211/187 |
| 5,312,003 | 5/1994 | Domenig | 211/144 |
| 5,458,243 | 10/1995 | McBride | 206/503 |
| 5,577,344 | 11/1996 | Zaremba et al. | 211/205 |
| 5,584,398 | 12/1996 | Lin | 211/188 |
| 5,683,004 | 11/1997 | Aho | 211/187 |

*Primary Examiner*—Daniel P. Stodola
*Assistant Examiner*—Jennifer E. Novosad
*Attorney, Agent, or Firm*—Adrienne B. Naumann

[57] ABSTRACT

A spatially and mechanically independent removable display attachment with wedge retainers for vertical cylindrical supports which consists of a flat member surrounded by an upwardly rising rim and an upwardly protruding open tubular segment. The opening completely pierces the flat member, so that a pole or pipe can easily slide through the invention. The attachment is supported at various vertical distances along the pole by a combination of structural innovations, O-rings, and in intimate physical contact and combination with wedgelike retainers.

13 Claims, 11 Drawing Sheets

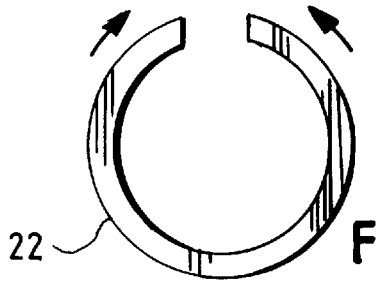
FIG. 10a
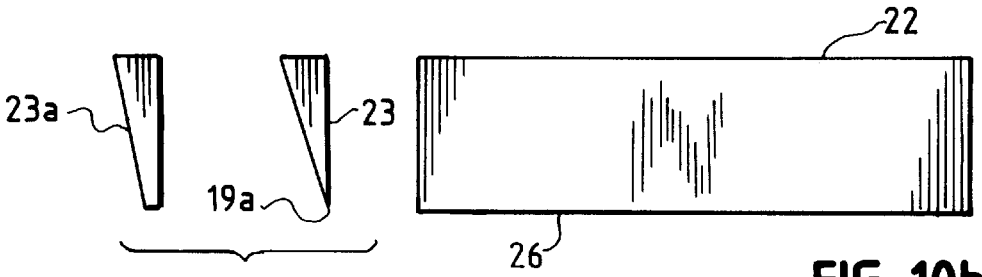
FIG. 10b
FIG. 10c
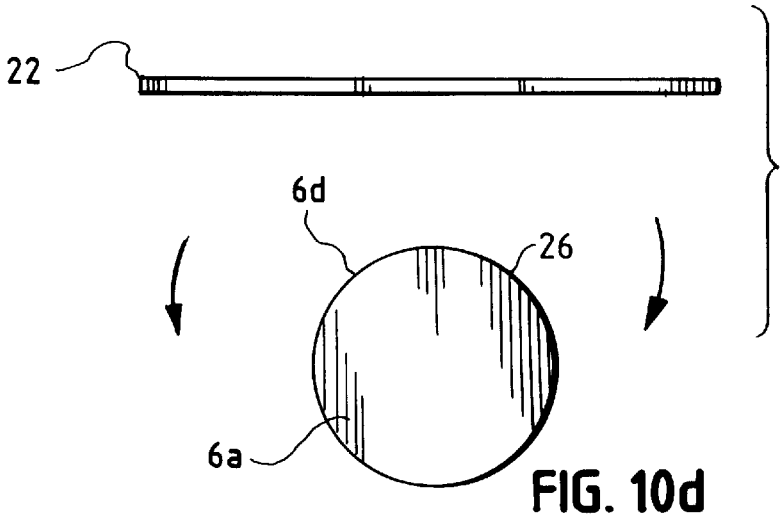
FIG. 10d
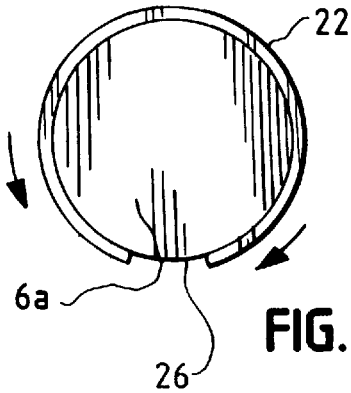
FIG. 10e

REMOVABLE DISPLAY ATTACHMENT WITH WEDGELIKE RETAINERS FOR VERTICAL RIGID CYLINDRICAL SUPPORTS

This application is a continuation in part of U.S. application Ser. No. 08/587,009 filed Jan. 16, 1996, George Julian Zaremba, inventor, now U.S. Pat. No. 5,715,954.

BACKGROUND OF THE INVENTION

The present invention relates to a structure which functions as a removable display container when combined with supportive wedgelike retainers. More particularly, the present invention [hereinafter referred to as the removable display attachment with wedge-like retainers for rigid vertical cylindrical supports], relates to an object with a raised open tubular segment which may hold a multitude of decorative objects, merchandise, or books, etc. on a shelf.

Attachment displays can be at or near the bottom of a pole, as a shelf at the top of a pole, or at any other vertical height at right angles to a vertical pole. In the preferred embodiment such removable display attachments always are intimately associated with snugly fitting wedgelike retainers, which will be discussed in detail, infra.

There has been a long-standing need in grocery and other consumer oriented industries for lightweight versatile mechanical structures to display decorative objects or merchandise. Such structures must be inexpensive and the components must fit over standard sized pedestals, pipes or poles. In the prior art, attachments were glued to or pushed into a bottom container or stand to support a pole. The top of the pole could also support a shelf or container with appropriate adhesive.

In store floor displays, shelves were fixed at specific heights on a pole. They were also constructed in a modular fashion whereby a container was placed on a short pole (or poles) with another short pole (or poles) inserted into the container to support the next container, and so on.

However, none of the previous display components have an open protruding circular segment easily positioned along a standard sized (diameter) plexiglass pole, either as (i)a bottom base or container; (ii) a container or shelf positioned along a pole in combination with a (iii)a wedge-like retainer to suspend the container along a pole.

SUMMARY OF THE INVENTION

To solve this long-standing problem in the art, the present invention, ie., the removable display attachment in combination with wedgelike retainers, provides an improved component on a standard plexiglass pole. Other types of poles, such as resinous, wooden, or metal, are also contemplated within the scope of my invention. In my preferred embodiment the plexiglass pole has a diameter of between one and a quarter inch, or one and one half inch in diameter and can be best described as an "off the shelf" item.

The user can manually arrange several attachments to a pole in seconds. My removable attachment can function as a container or shelf and can be used on any vertical pole, pipe, pedestal or similar device. Accordingly, an object of the present invention is to provide an improved, more versatile container for decorative or merchandising arrangements.

Another object of the present invention is to provide an improved stronger, yet lightweight bowl made from durable low cost plastic to support decorative displays or merchandise.

Another further object of my invention is the use of flexible O-rings for vertical support.

A further object of the invention is to provide a container or shelf which the user can attach to a standard diameter plexiglass pole at any vertical height, or at the top or bottom of the pole, without adhesive.

Another object of my invention is use of flexible triangular wedge-like retainers which fit within spaces between the removable attachment and the pole.

Another object of my invention is removal of an attachment which contains a floral arrangement and giving it as a table gift, thus saving the more expensive pole or pedestal for subsequent use.

Another object of my invention is the use of modified attachments and wedgelike-retainers which function as plastic rims in pole openings in a board or shelf, and which allows a pole to slide through.

These and still other objects and advantages of the invention will become apparent from the following description of the preferred embodiment of my present invention, as well as other embodiments.

BRIEF DESCRIPTION OF THE DRAWINGS

My invention may be better understood by reference to the drawings accompanying this specification:

FIG. 7*c* illustrates a second wedge retainer.

FIGS. 10*a*, 10*b*, and 10*c* illustrate wedgelike retainers comprising a flexible band and triangular crossection. FIGS. 10(*d*) and 10(*e*) illustrate how this flexible band wraps around a pole.

DETAILED DESCRIPTION OF THE INVENTION

Figure 1A:
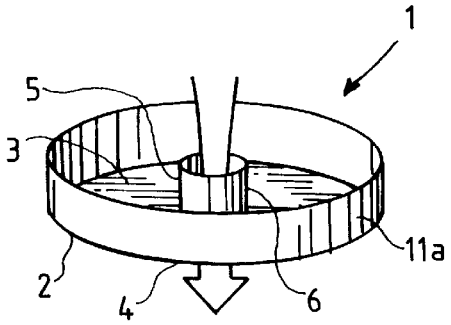
FIGS. 1 *a,b,c* are slightly tilted side views and a diagrammatic cross-section of the removable display attachment component of the invention.

The present invention, hereinafter referred to as "removable display attachment with wedgelike retainers on vertical rigid cylindrical supports," 1*a* comprises a removable display attachment 1, as a first component. Display attachment 1 has a flat bottom member 2. This member has a top surface 3 and bottom surface 4. Extending upwardly from the top surface 3 is an open tubular segment 5 with a continuous wall 5*a*.

In the preferred embodiment the tubular segment 5 has an opening 6 so that the top and bottom surfaces of the removable display attachment coextensively have an opening through which a second object, such as a pole 6*a* may pass. Tubular segment wall 5*a* has a predetermined height and that height has a midpoint. The entire removable attachment 1 component is rigid in the preferred embodiment, although more flexible embodiments are also within the scope of my invention.

In the preferred embodiment, the lower edge 7 of the tubular segment wall 5*a* is contiguously molded to and at right angles with the upper surface 3. Tubular segment 5 also has an exterior surface 8 and an interior surface 9. Tubular segment 5 has an uppermost edge 10.

Also extending upwardly from top surface 3, and at right angles to surface 3 is a rim 11. The rim may or may not be the same height as the upper edge 10 of open tubular segment 5. The rim has an outer surface 11*a* and an inner surface 11*b*. Surface 3 extends from the bottom 7 of tubular segment 5 to rim 11, so that rim 11 forms the periphery of flat member 2.

In my preferred embodiment, the removable display attachment 1 component is round, but may be any shape within the scope of my invention. Also in the preferred embodiment of my invention, the open tubular segment is concentrically placed within top surface 3. However, other positions of the tubular segment 5 upon flat member 2 of the preferred embodiment are also contemplated. The preferred embodiment contemplates a tubular segment 5 which is cylindrical in shape. Again however, my invention contemplates tubular segments 5 which are larger, narrower, or of different shapes.

In the preferred embodiment for the floral industry as a table-top pedestal, the round bottom member 2 is approximately six inches in diameter. In the merchandise display industry the preferred dimensions are 18 inches to 24 inches in diameter. The open tubular segment is approximately one inch in height from the upper surface of the bottom member. The circular opening 6 within tubular segment 5 is approximately one and one half inch in diameter. The circular rim 11 is approximately one and one half inches in height from the bottom surface 4.

Other measurements and dimensions are also contemplated within the scope of this invention, however. The preferred thickness of the rim 11 is approximately one-eighth of an inch, but again, thickness can vary. In the preferred embodiment for the floral or display industry, my removable display attachment 1 can slide over a standard plexiglass pole 6*a* (or pedestal or pipe) to function as a bottom support or container.

To operate the removable attachment 1 component, the pole 6*a* (for example)is initially pushed through the opening 6 of tubular segment 5. Besides being positioned at the bottom of the pole as a base or container, or at the very top of the pole 6*a* as a container or shelf, removable display attachments 1 can also be aligned with supporting O-rings 15 along the pole.

However, in the preferred embodiment a wedge-like retainer 16 is placed in combination with the removable attachment 1. Wedge-like retainer 16 and its variations will be described in more detail below.

Figure 1B:
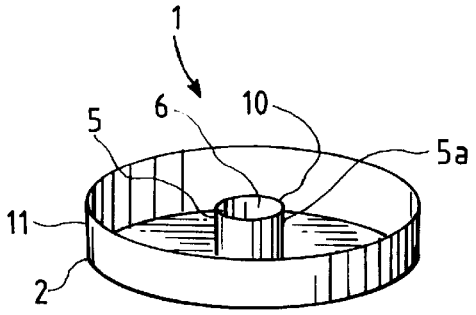
Figure 1C:
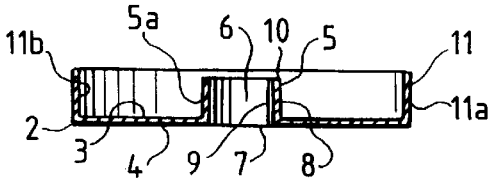

FIGS. 1(*a*),(*b*),(*c*) illustrates the removable display attachment component 1. The removable display attachment 1 comprises a rim 11, and top and bottom surfaces 3 and 4 respectively of flat member 2. In FIG. 1*c*, in cross section, the tubular segment 5 is shown facing upwardly from top surface 3.

Figure 2:
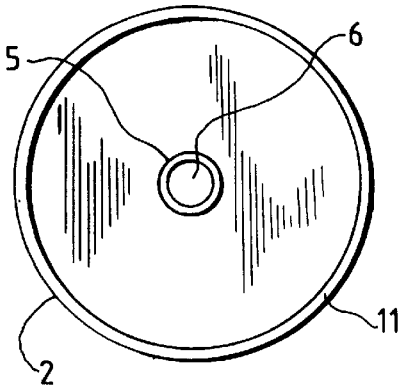
FIG. 2 is a plan view of the upper surface of the removable display attachment.

FIG. 2 is a plan view looking down on tubular segment 5. The preferred embodiment is shown, with a circular flat member 2, tubular segment 5 concentrically located, and opening 6 piercing bottom surface 4 of the invention(not seen in this view).

Figure 3:
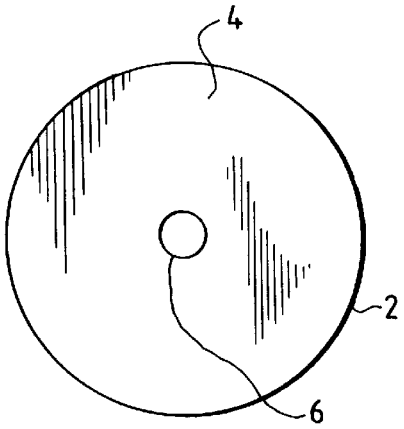
FIG. 3 is a plan view of the lower surface of the removable display attachment.

FIG. 3 is a plan view of the bottom surface 4 of the flat member 2. The opening 6 can be seen in this view as well as in FIG. 2, as opening 6 completely penetrates flat member 2.

Figure 4:
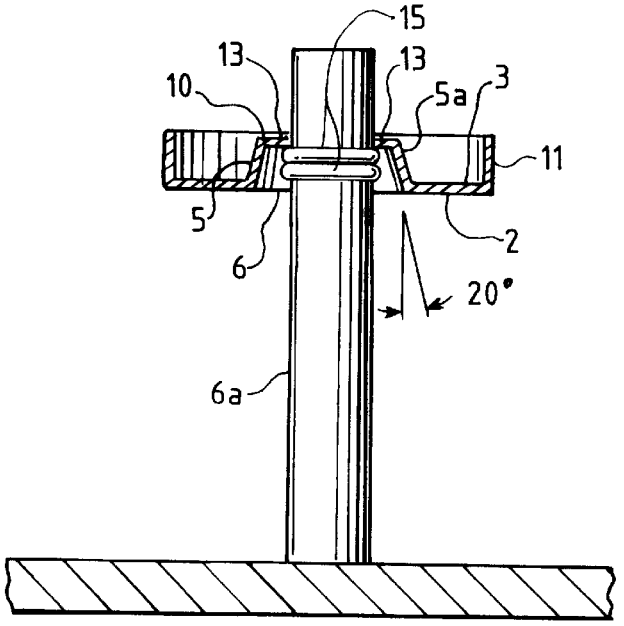
FIG. 4 demonstrates a cross section of the removable display attachment with O-rings and an upper lip.

In FIG. 4 the lip 13 is a platform oriented interiorly toward opening 6 and contiguous with edge 10 of wall 5*a*. Lip 13 rests upon O-ring 15. The second O-ring gives additional frictional support to prevent slippage. There is also some wedging effect, but support originates from lip 13. Wall 5*a* diverges from the vertical approximately 20 degrees, thus permitting the O-ring to wedge into this angle.

Also in FIG. 4, no less than one generic rubber O-ring 15 is positioned immediately below the removable display attachment lip 13. Such O-rings prevent sliding and slipping. O-rings, in different varieties, are considered an "off the shelf" item in the industry and are easily obtainable at a lumber yard or hardware store.

Figure 5:
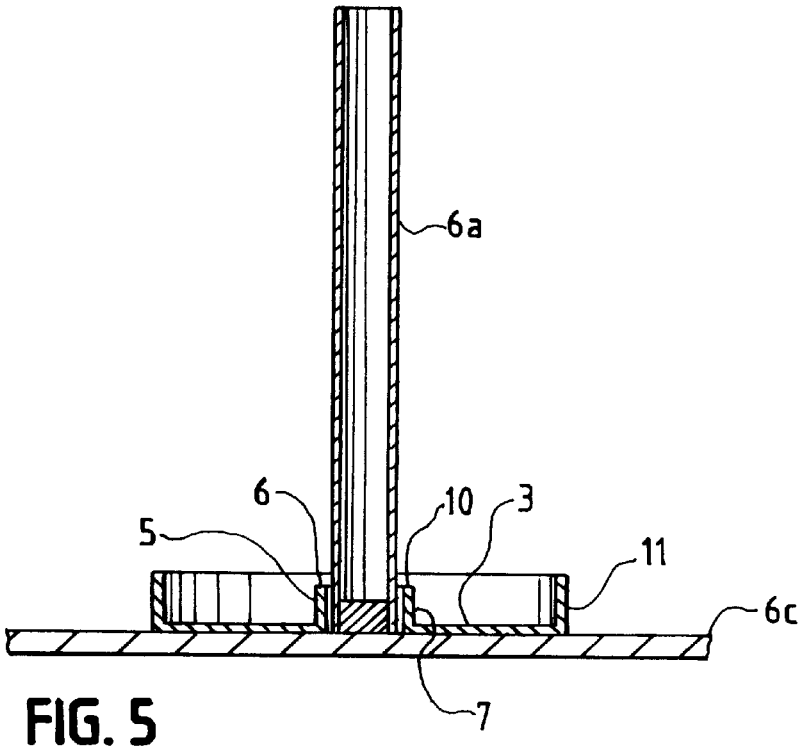
FIG. 5 demonstrates a cross section of the removable display attachment without any lip resting on a horizontal surface.

FIG. 5 illustrates the removable attachment in cross-section, without any lip, at the base of a pole or pedestal 6*a* oriented 90 degrees from a horizontal surface. In this embodiment there is no divergence from the vertical by walls 5*a*, because there is no support or sliding problem: the attachment can rest on the horizontal surface 6*c* as a ballast. One can make the removable attachment in FIG. 5 from plastic such as styrene, which has a low shrinkage coefficient. This attachment can loosely surround the pole, and can hold a floral arrangement at the base of the pole.

Figure 6A:
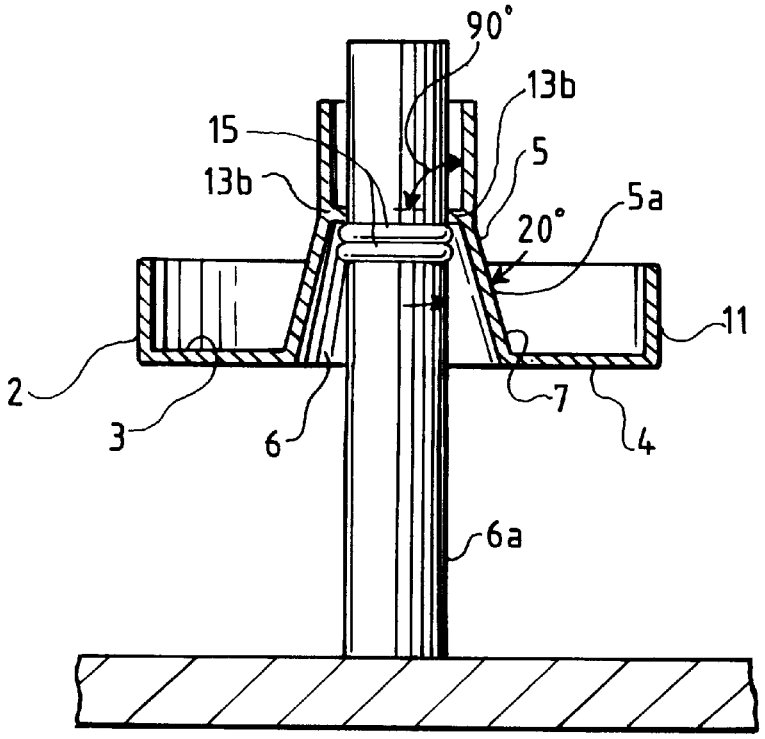
FIG. 6*a* demonstrates a cross section of a display attachment with a lip located at the midpoint of the tubular segment and supported by two O-rings.

FIG. 6*a* illustrates a cross section of a two embodiments of removable attachment 1. FIG. 6*a* reveals an O-ring 15(or two O-rings for extra friction) which braces a removable attachment 1 along a vertical pole, pedestal, or pipe 6*a*. In this embodiment, however, the lip 13*b* is located midway (medially) between the top edge 10 and the bottom edge 7 of tubular segment 5. Lip 13*b* is oriented interiorly toward the center of opening 6 and is completely contiguous with the inner wall 8 of wall 5*a*.

Lip 13*b* sits on O-rings, with some wedging but primarily support comes from lip 13*b*. The tight fit of the top half of segment 5 prevents swaying. However, the fit should not be so tight as to scratch the pole when the container is slid down the pole. The snug fit prevents the attachment 1 from swaying like a seesaw with an up and down motion.

Lip 13*b* is oriented interiorly toward the pole to hold the removable attachment 1 at a particular vertical height. The divergence of 20 degrees from the vertical, begins at the medially located lip towards bottom edge 7. The wall 5*a* of the tubular segment 5 above the lip retains vertical (90 degree)orientation with respect to the horizontal surface upon which the pole rests 6*c*.

Figure 6B:
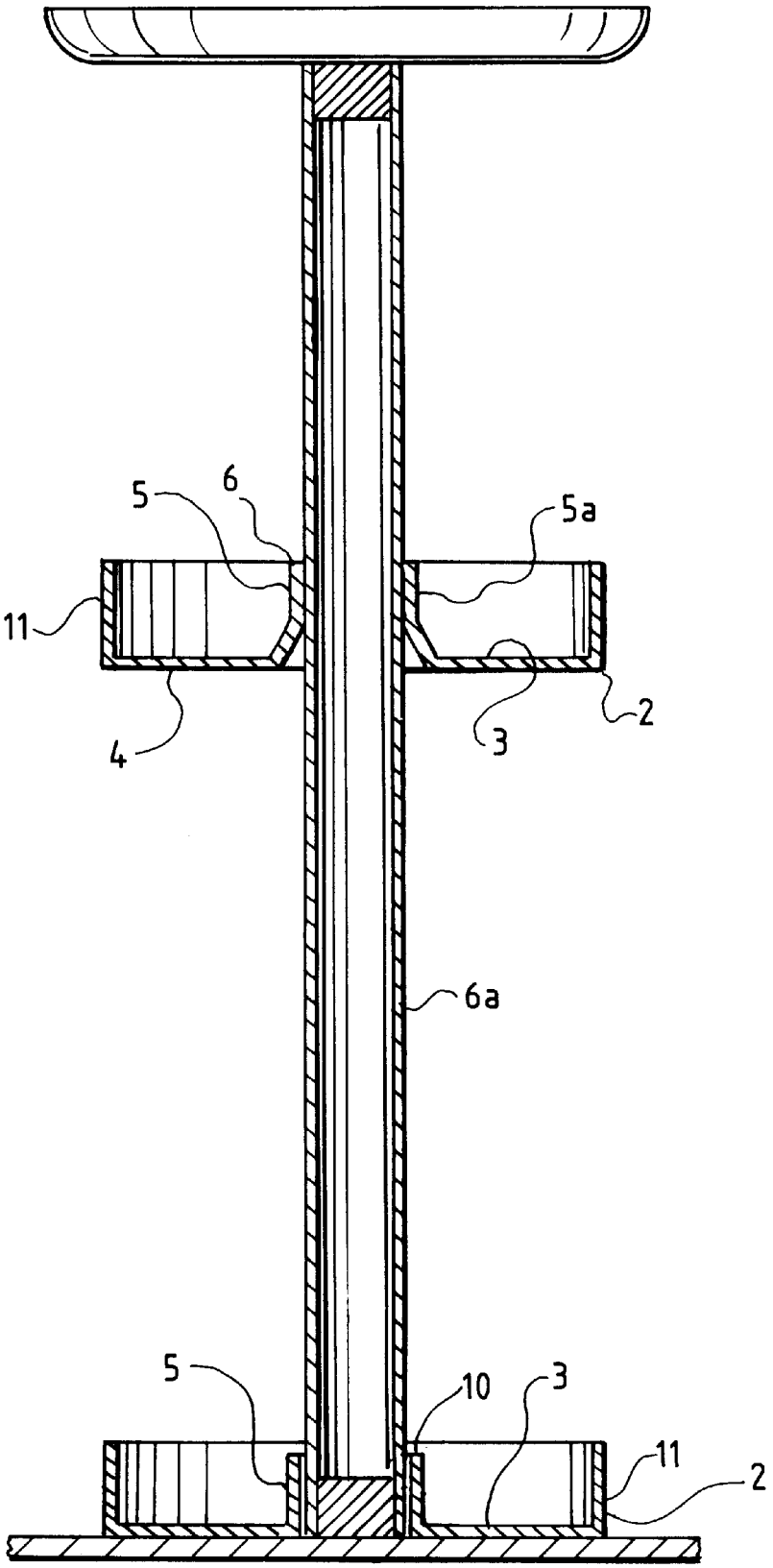
FIG. 6*b* demonstrates two attachments with no lips, positioned along a vertical pole.

As seen in FIG. 6*b*, without a lip or O-rings, the top half of segment 5 above the lip should be a tighter fit. The bottom half of segment 5 should be a looser fit to the pole 6*a* to leave room for other mechanical and/or frictional supports. The tighter fit of the top half of the tubular segment can also be achieved by a smaller diameter at 5*a*. The purpose of a tighter fit at the top half of the segment 5 is to prevent swaying.

In FIG. 6*a*, the inner diameter of lip 13 or 13*b* should be slightly greater than the outer diameter of the pole 6*a*. In this manner the attachment 1 can slide loosely down pole 6*a*.

Figure 15A:
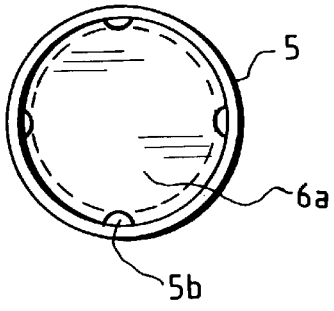
FIGS. 15*a* and 15*b* illustrates in side view and plan view the ridge feature of my invention.
Figure 15B:
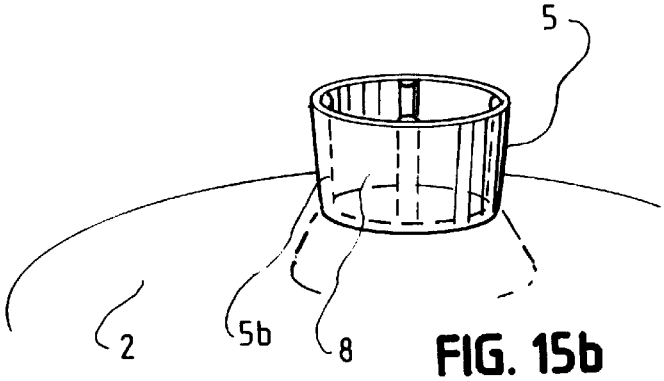

An alternative and/or supplemental approach to a tight fit of the top half of segment 5 comprise vertical ridges 5*b*. Ridges 5*b* decrease the diameter of inner tubular wall 8 for a tighter fit. Such vertical ridges 5*b* are structurally part of removable display attachment 1. Generally there are three to four ridges equidistantly spaced. See FIGS. 15*a*, 15*b*.

Different sizes and shapes of my removable display attachment 1 can be used along the pole with modification of the above described features. Such modifications include additional O-rings, or a wider lip, either at the top edge 10 or at the midpoint of tubular segment 5.

Figure 7A:
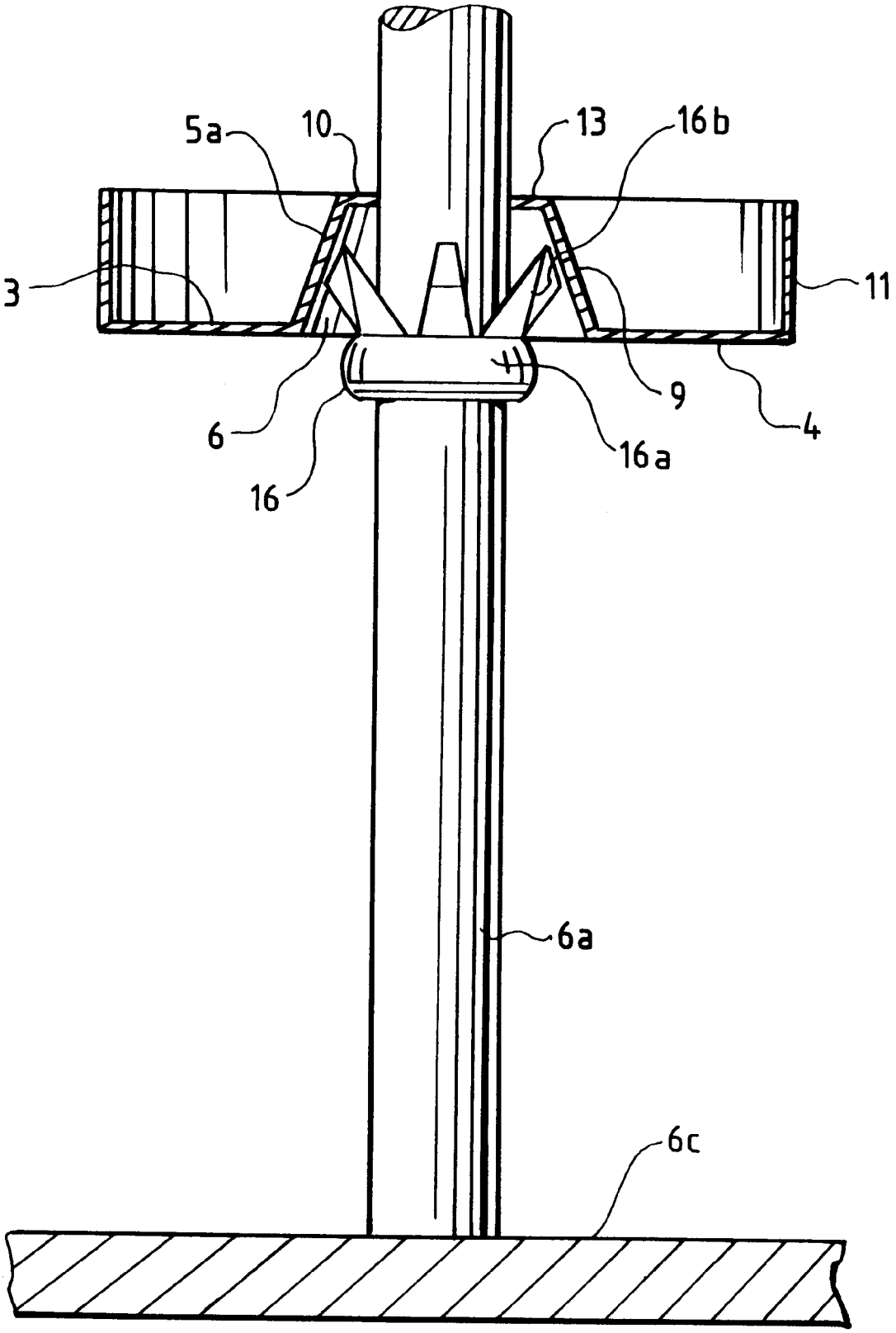
FIG. 7*a* demonstrates in partial cross section the removable display attachment in combination with a wedgelike retainer.

FIG. 7*a* illustrates a cross-section of an embodiment of my invention 1*a*. Invention 1*a* comprises my removable display attachment 1 in combination with a physically separate component wedge-like retainer 16. The wedge-like retainer 16 is in intimate physical contact to support a removable display attachment 1 along pole 6*a*. The removable attachment 1 may have lip 13 or lip 13*b* or no lip, with appropriate divergence of the tubular segment wall 5*a*.

Still referring to FIG. 7*a*, immediately beneath the removable attachment 1 in the embodiment is a rigid plastic ring 16*a*. This ring further comprises three or four wedges 16*b* protruding upwardly or downwardly, and they are approximately ½ inches in height. The wedges 16*b* are triangular on each face(and pyramidal in shape) and spaced equidistantly from each other along ring 16. Other dimensions and shapes are also within the scope of my invention.

Wedges 16*b* may have protruding apexes 19*a*. Wedges 16*b* are of a size to fit snugly within the spaces created by the divergence of the tubular wall 5*a* from either a medially or uppermost located lip 13,13*b*. FIG. 7*a* illustrates upper lip 13. Any "wobble" originating with divergence of tubular wall 5*a* from the vertical is prevented by the tighter half of removable display attachment 1. Wobble is also minimized by the mechanical and frictional interaction of the wedges 16*b* and divergent tubular wall 5*a*.

Figure 7B:
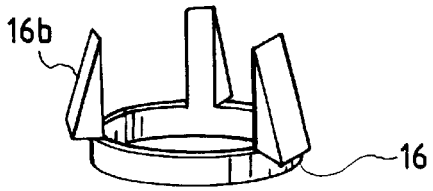
FIGS. 7*b* and 7*c* illustrates a wedge retainer.
Figure 7C:
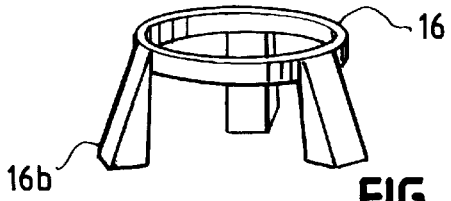

In sum, wedge-like retainers 16 and removable attachment 1 create stable functional unit 1*a*, which in turn together comprise my invention. Additional weight with the wedge-like retainer 16 in place is better, because the weight creates a tighter wedging effect to support, for example, a book shelf. As shown in FIG. 7*b*, ring 16 is necessary because it is inconvenient to manually align three separate wedges during assembly.

Figure 8:
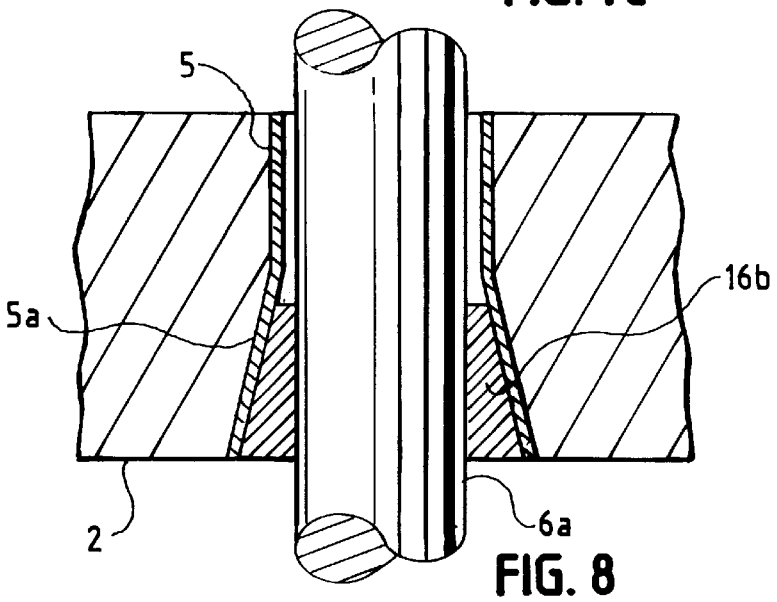
FIG. 8 illustrates a wedgelike retainer in cross section with blunt apexes.

FIG. 8 illustrates a variation of the wedge-like retainer 16. In cross section one can see the spaces filed by wedges 16*b* between the taper of wall 5*a* and the vertical of the pole or pedestal 6*a*. Here, wedges 16*b* have blunt apexes so that with additional pressure or weight, the wedges have space to generate more support.

Figure 9:
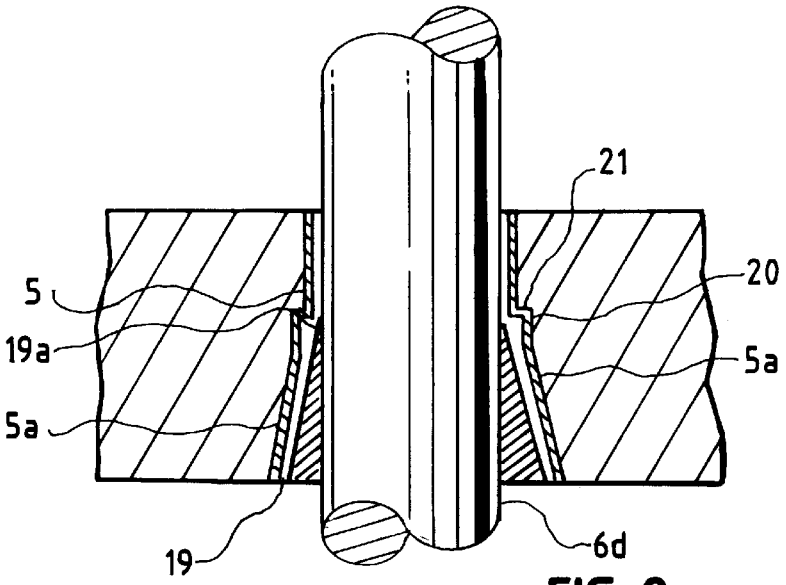
FIG. 9 series illustrates a wedgelike retainer in cross section with pointed apexes.

FIG. 9 illustrates wedges 16*b* with apexes 19*a* which are pointed. However, there is a rectangular space 20 above each apex 19*a*. This space is formed by wall 5*a* extending for a short distance 21 at right angles to pole surface 6*d*, thus creating a straight wall segment 5*a* of approximately ⅔ inches. If there is excessive downward pressure, the rectangular spaces 20 will accommodate a tighter fit of wedge member 16*b*.

FIGS. 10 *a,b,c,d,e* illustrate another variation of wedge-like retainer 16. FIG. 10*a* illustrates band 22, which is comprised of silicon rubber, which is well known in the industry. Band 22 is triangular in cross section 23,23*a*. When wrapped around pole 6*a*, the band is approximately 5% to 10% shorter than the circumference. This feature allows for a minimal expansion of the wedge-like retainer 16.

Figure 11A:
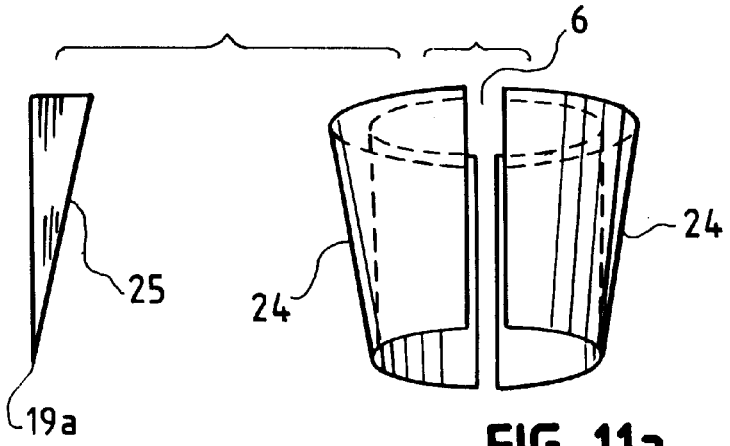
FIGS. 11*a*, 11*b* and 11*c* illustrate a wedgelike retainers comprising discontinuous circular halves which are triangular in cross-section.
Figure 11B:
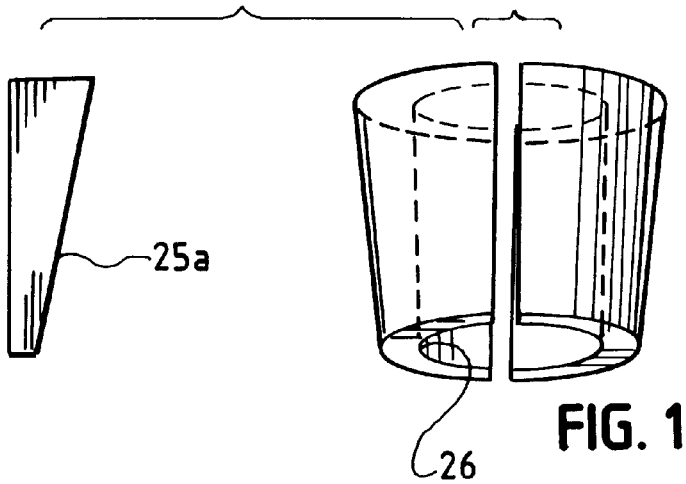
Figure 11C:
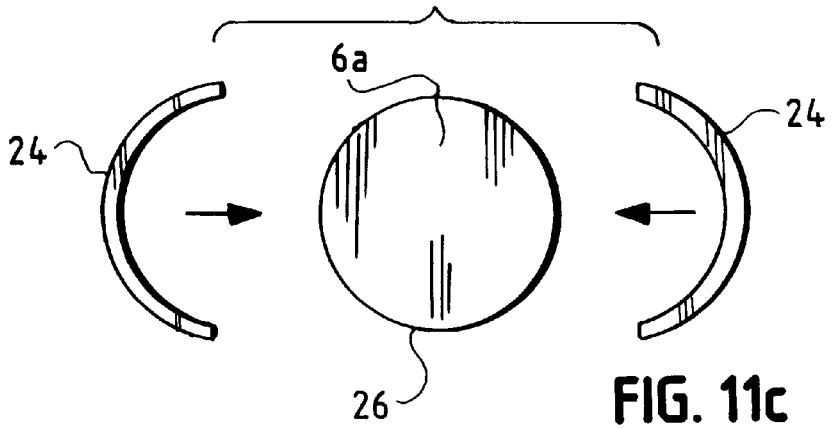

FIGS. 11 *a,b,c* illustrate discontinuous semicircular wedge-like retainers 24. Two semi-rigid semicircular halves 24 contact pole 6*a*, and are triangular in cross section. These cross-sections may comprise either blunt or pointed apexes 19*a* as seen in cross section 25, 25*a*. Halves 24 perform the same function as band 22, i.e., to support removable display attachment 1.

These contiguous halves are comprised of a hard rubber-like substance well known to those in the industry. The total circumference of halves 24 should be 5% to 10% shorter than the pole's 6*a* circumference 26. This feature allows for minimal expansion of the rubber if the wedge-like retainer 16 expands.

All wedge-like retainers 16 can be used in combination with any embodiments of the removable attachment display 1, with either blunt apexes or pointed apexes within rectangular spaces 20, to comprise invention 1*a*. However, the PREFERRED EMBODIMENT OF MY INVENTION 1*a* comprises: (1) the removable display attachment 1 with a medially located lip as previously described herein; (2) a wedge-like retainer 16 in the form of a band 22 with triangular cross section, and such triangular figures comprising blunt apexes as previously described herein. This preferred embodiment is the same for both floral and merchandising applications.

Figure 12A:
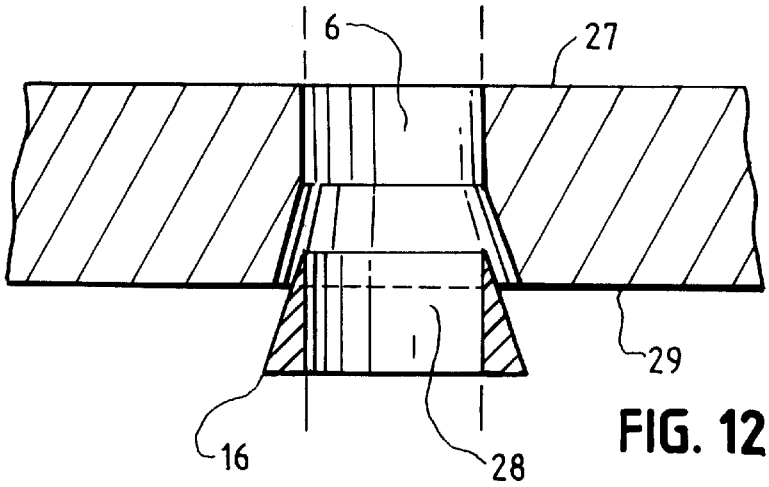
FIG. 12*a* in cross sections illustrates wedge supports at the lower access of a shelf.

FIGS. 12 *a,b,c* illustrate the use of the removable display attachment 1 with four wedgelike retainers 16 in one piece of shelf material 27. This shelf material 27 is any inexpensive medium density fiberboard or wood particle substance. The shelf or board 27 is approximately ¾ inch to one inch thick. In this illustration four openings 28 *a,b,c,d* are drilled into the board concentrically, but from opposite sides of board 27. Each opening flares outwardly toward the bottom surface 29 for a wider exit. See FIG. 12*a*. However, fewer or more openings or varying circumferences within such a board or shelf are also within the scope of my invention.

Figure 12B:
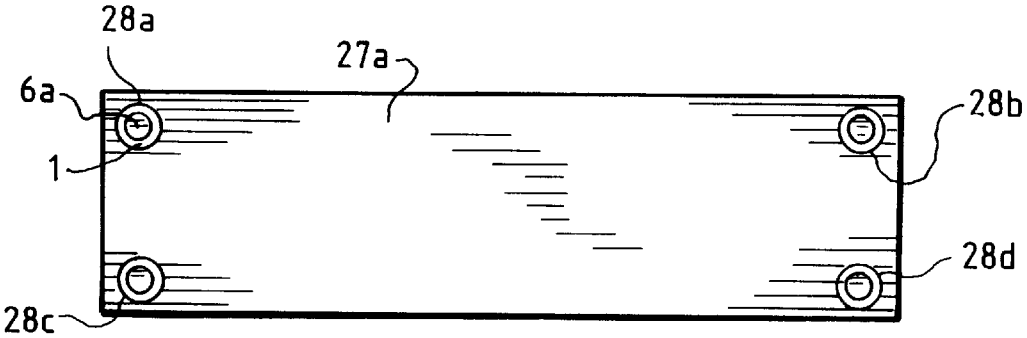
FIG. 12*b* illustrates in upper plan four removable display attachments with wedge-like retainers(not seen) within a shelf.

FIG. 12*b* illustrates one shelf in upper plan view, and looking down upon the upper surface 27*a* of board 27. Each inner circle 6*a* within each larger circle 1, represents a cross-section of a pole 6*a* surrounded by a removable display attachment 1. One cannot see the wedge-like retainers 16 from this view.

Figure 12C:
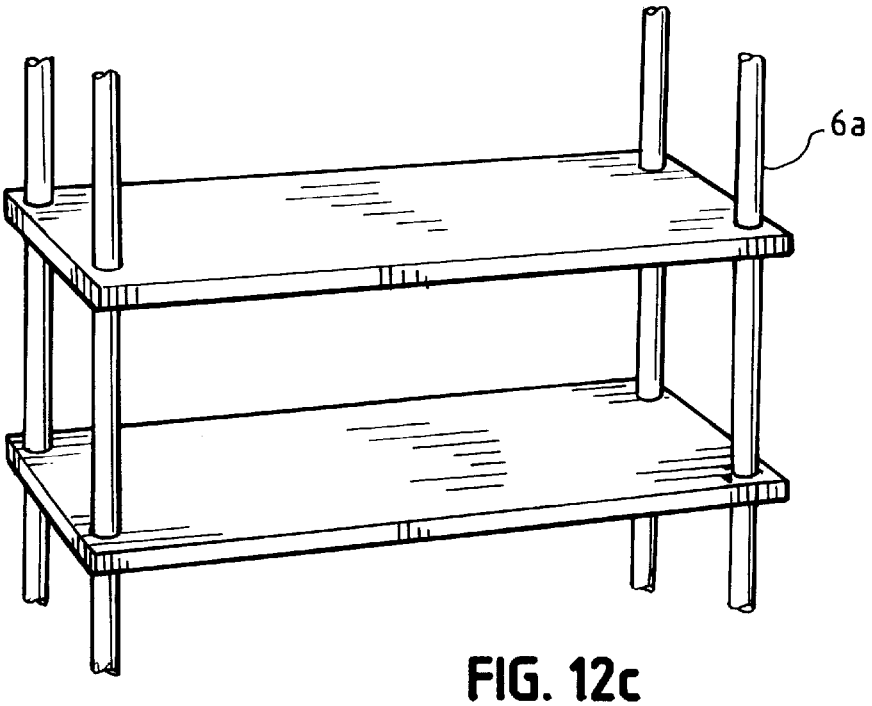
FIG. 12(*c*) is a partial front view illustrating several levels of shelves supported by a plurality of the invention.

FIG. 12*c* illustrates a partial frontal view of a plurality of shelves held together by a plurality of removable display attachments 1 and wedgelike retainers 16 in combination 1*a*.

Figure 13A:
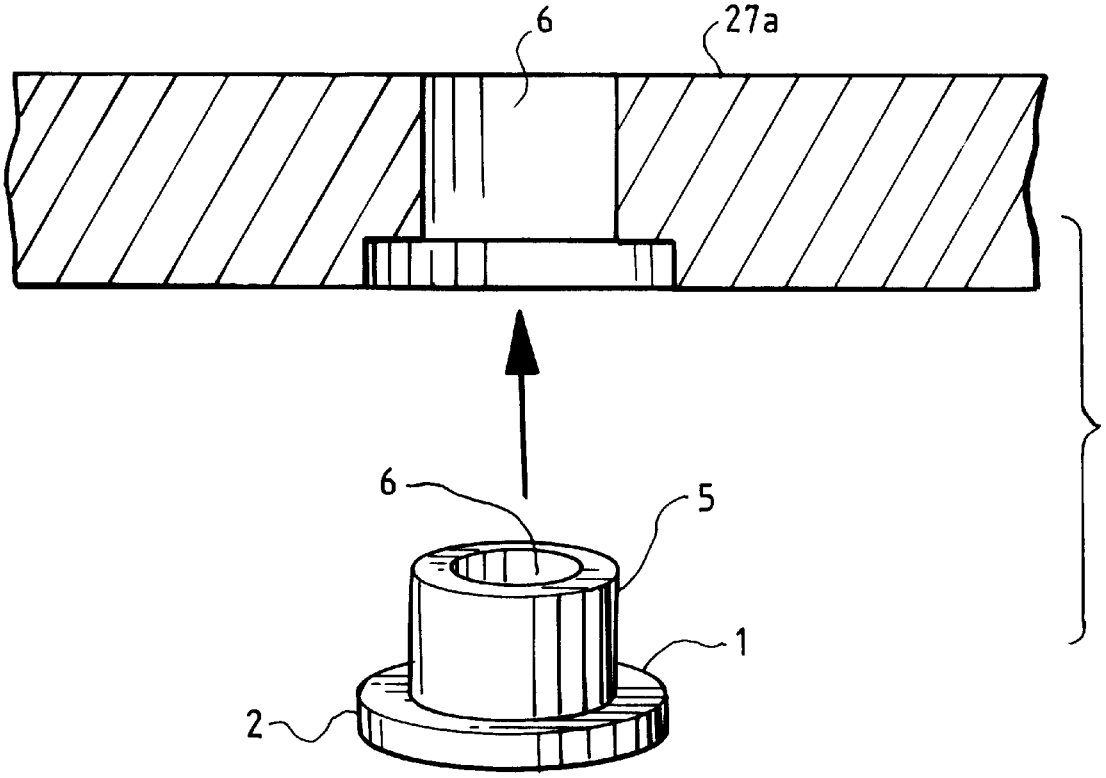
FIGS. 13*a* and 13*b* illustrate modified removable attachments with wedge-like retainers in frontal view and cross section.

As illustrated in FIG. 13*a*, removable attachment 1 is modified when used in multiple shelf applications. As part of this modification, bottom flange 2 is reduced in size both dimensionally and relative to outer wall 9 of tubular segment 3. If the board or shelf is plastic, then the kit with the shelving elements will be approximately ten times more expensive than an analogous kit with particle board components. As result, the materials of choice for shelves are particle board and similar woodlike materials.

The removable display attachment 1 should be as tall as the depth of the particular shelf or board 27, ie. generally approximately ¾ inch. The attachment 1 and wedgelike retainer 16 are excellently adapted to function simultaneously as (1) an opening through which the a pole can slide and allow for change in height of the shelves; and (2) with or without glue, an excellent plastic liner for each opening which is drilled into the particle board. Such a plastic liner makes each opening through a board more permanent, neat, durable, and smooth.

Figure 13B:
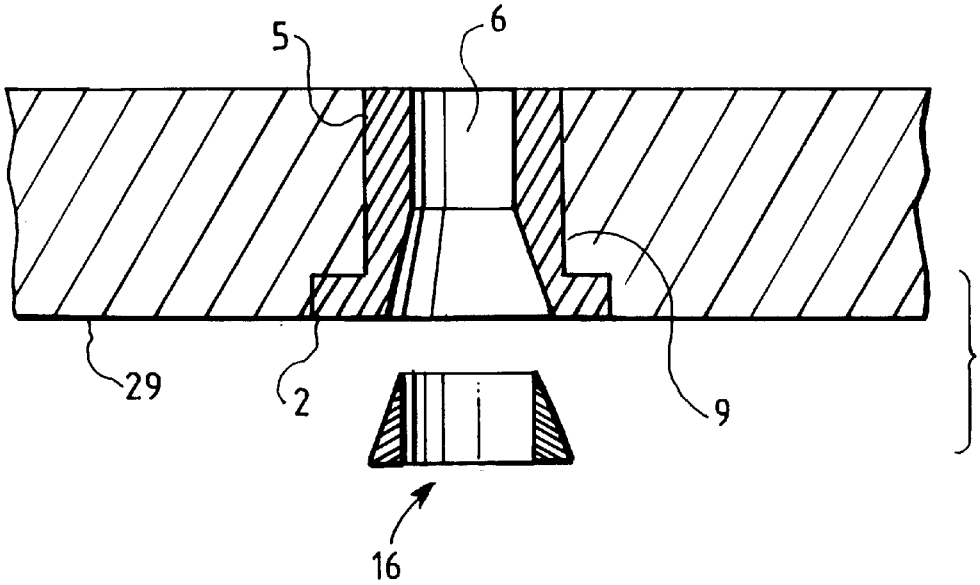

FIG. 13*b* illustrates the undermount approach of inserting the entire invention 1*a* (attachment 1 and retainer 16) into the opening in a board or shelf. In this manner, without adhesive, it completely lines the opening 6 in the wood and rests on the flared opening in lower surface 29.

Figure 14A:
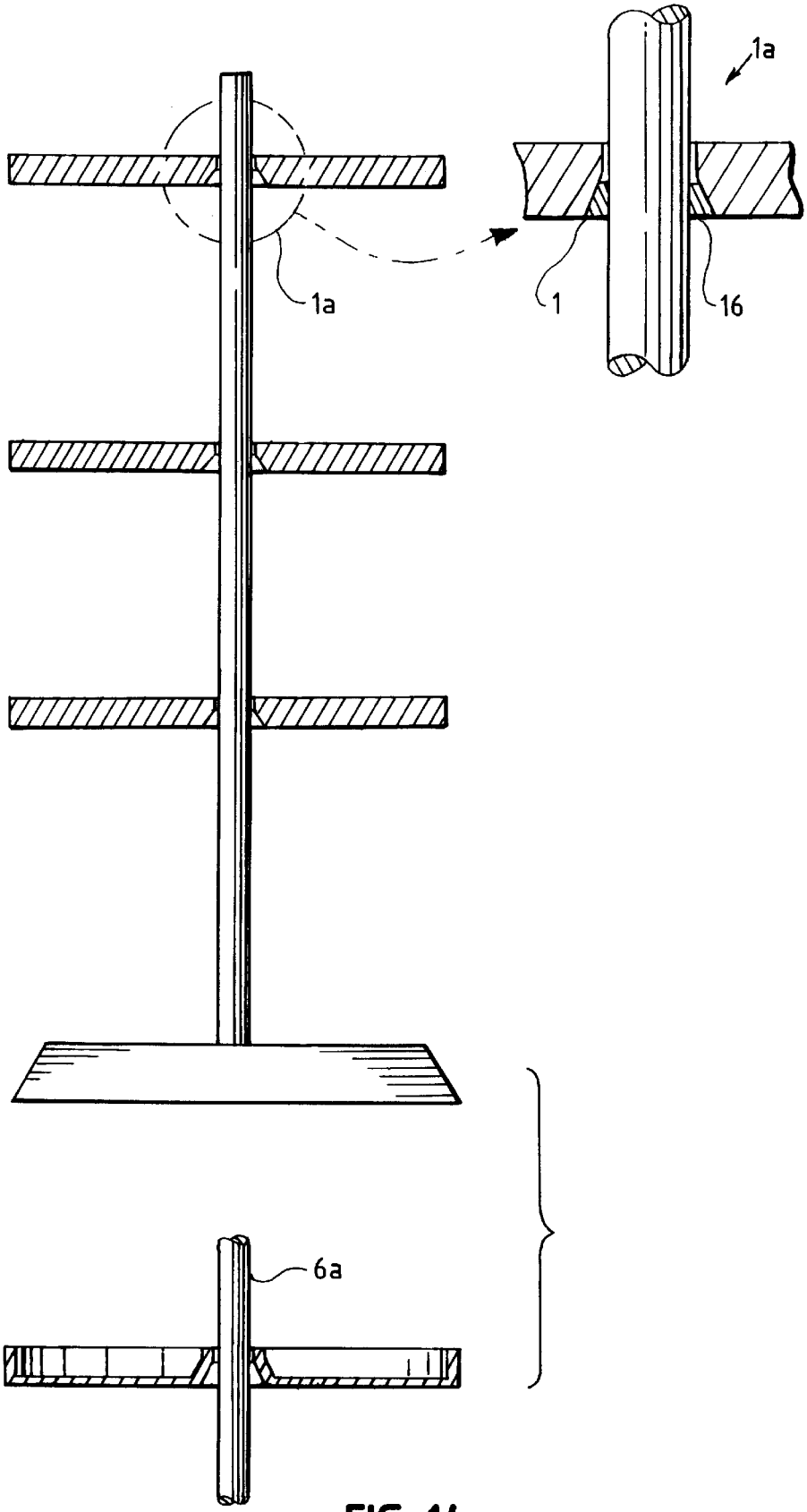
FIG. 14*a* illustrates several removable attachments with wedge-like retainers from a kit for removable display attachments at adjustable heights.
Figure 14B:
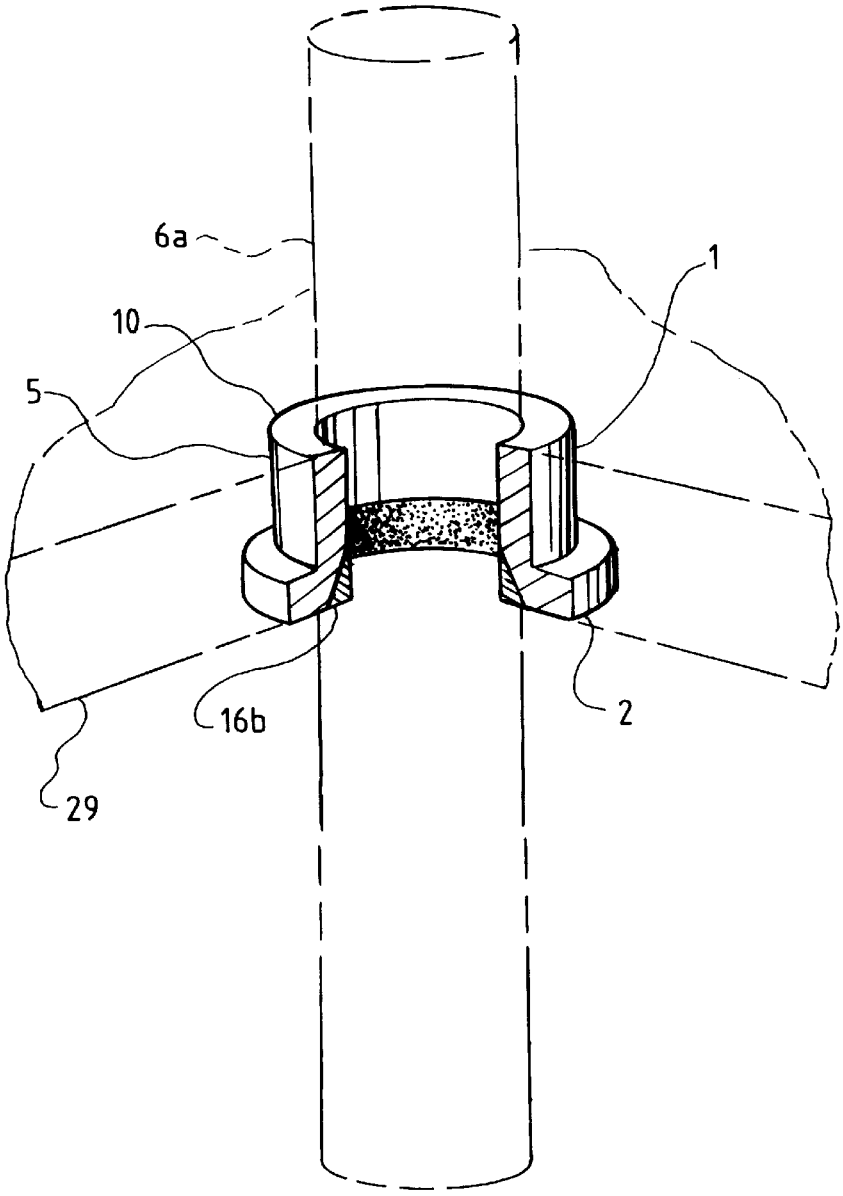
FIG. 14*b* illustrates in detail in cutaway section how the inventions is positioned within a shelf.

One commercial use of my invention 1*a* is illustrated in FIG. 14. The removable display attachment 1 is made of a plastic such as polypropionate, and is approximately one inch in height. The bottom flange 2 is approximately ¼ inch in radius. Each removable display attachment 1, when inserted into an outwardly flared opening 6 in lower shelf surface 29, will support each shelve along pole 6*a*, in combination with wedgelike retainers of choice 16.

To rearrange the height of the shelves, the plastic display attachments 32 are merely removed along with the wedgelike retainers 16. In the prior art this adjustment was impossible because the shelving components could not slide up and down the pole nor be removed from the shelving material. Instead, they were generally nailed or glued together in a permanent manner.

The economics of my removable attachment are remarkable. With what is now available in the industry, to assemble a similar display with glue and then remove a portion and give it to a third party is very expensive. Such conventional displays now available in the prior art may cost from six to eight dollars apiece when the entire combination is given away without compensation to a third party.

In contrast, my removable display attachment is an inexpensive liner and waterproof container, which costs approximately eighty cents apiece to produce. This price differential is of particular value in decorative arrangements which are often given as party favors in these containers. The removable attachment display is generally integrally molded of inexpensive plastic, but other materials are contemplated within the scope of this invention. The molding process is standard, and one generally well recognized in the plastics industry by those skilled in the art.

As illustrated from the above descriptions, one of the most crucial features of my invention 1*a* is the versatility of the removable attachment 1 in combination with a wedge-like retainer which is in intimate contact with, and assists in supporting any attachment bearing additional weight. My invention can function at any height or with the tube segment facing upwards or towards the floor. In sum, my invention is versatile, inexpensive, easily stored, and does not require an adhesive.

What is claimed is:

1. A display assembly in combination with and in physical contact with a liner in subcombination with retainers and vertical rigid cylindrical supports, (A) said display assembly comprising:

(a) at least one piece of shelving material, said piece of shelving material comprising an upper surface and a bottom surface, (i) said piece of shelving material having a predetermined thickness, (ii) said thickness further defining a depth of said piece of shelving material between said upper surface and said bottom surface, (b) an opening contiguously penetrating said upper surface and said bottom surface of said piece of shelving material, said opening being the same depth as said piece of shelving material, said opening having an inner surface, (i) said opening wider at said bottom surface of said piece of shelving material than at said upper surface, (ii) said opening further comprising an inner contiguous wall, (B) each said retainer comprising in subcombination:

(a) a liner, said liner being of approximately the same depth as said depth of said piece of shelving material between said upper surface and said bottom surface of said piece of shelving material, (i) said liner composed of a water proof plastic, said liner comprising an inner surface, (ii) said liner comprising a protruding cylindrical tubular segment, said protruding cylindrical tubular segment further comprising an upper tubular edge and a lower tubular edge, said protruding cylindrical tubular segment further comprising a first cylindrical opening which extends from said upper tubular edge of said protruding cylindrical tubular segment to said lower tubular edge, (iii) said liner further comprising a flange, said flange comprising a top surface and a bottom surface, said flange comprising a second cylindrical opening contiguous with said first cylindrical opening of said protruding tubular cylindrical segment, said first and second cylindrical openings penetrating said upper tubular edge of said protruding cylindrical tubular segment and said bottom surface of said flange, said opening encircling said outer surface of said vertical rigid cylindrical support, said flange further comprising an integral component of said protruding cylindrical tubular segment, said protruding cylindrical tubular segment integrally attached to said top surface of said flange, and extending upwardly therefrom, said liner being inserted from said bottom surface into said opening in said piece of shelving material, said liner resting within said opening, whereby said liner fits within said inner surface of said opening, said liner being of sufficient diameter to receive and encircle the vertical rigid cylindrical support, (b) a wedge retainer, said wedge retainer in subcombination with said liner, said wedge retainer further comprising:

(i) a circular band, said band composed of silicon rubber, said circular band having a triangular cross-section, said triangular cross section having a blunt apex, said band fitting snugly between said inner surface of said liner and an outer surface of said vertical rigid cylindrical support, (ii) said circular band comprising mechanical and frictional resistance to support said vertical rigid cylindrical support within said liner to prevent downward slipping.

2. The display assembly as described in claim 1, in which said piece of shelving material is composed of polypropri-onate and is approximately one inch in depth.

3. The display assembly as described in claim 1 wherein said piece of shelving material is composed of medium density fibre board.

4. The display assembly as described in claim 1 in which said liner is approximately ¾ inch in height.

5. The display assembly as described in claim 1 in which said flange of said liner is approximately one-quarter inch in radius.

6. The display assembly as described in claim 1 in which said piece of shelving material is rectangular in shape, said piece of shelving material comprises four corners, and said piece of shelving material comprising an opening in each of its four corners exiting through said bottom surface of said piece of shelving material.

7. The display assembly as described in claim 6, with a plurality of said pieces of shelving material, each said piece of shelving material supported by a plurality of said vertical rigid cylindrical supports, each said piece of shelving material disposed at a predetermined distance and parallel to, the remaining pieces of shelving material, each said piece of shelving material in parallel relationship to a support surface.

8. The display assembly as described in claim 1, in which said liner is supported by semirigid semicircular halves, said semirigid semicircular halves approximately encircling said outer surface of said vertical rigid cylindrical supports in a discontinuous circle and contiguously contacting at all points of said bottom surface of said flange, said semirigid semicircular halves each having a triangular cross-section, said semicircular halves snugly fitting within said opening within said flange, whereby said semirigid semicircular halves contribute sufficient frictional and mechanical resistance to prevent said piece of shelving material from sliding downwardly along said outer surface of said vertical rigid cylindrical support.

9. The display assembly as described in claim 1, wherein said wedge retainer comprises:

(a) said circular band comprising a circumference of approximately four inches and a width of approximately ¾ inch, (b) said circular band comprising a thickness of approximately one-eighth of an inch.

10. The display assembly as described in claim 1, said circular band of said retainer defining:

a plastic ring, said plastic ring being of sufficient circumference to encircle said vertical rigid cylindrical support, said plastic ring further comprising pyramidal protuberances which are integrally attached to said ring and protrude in an upward orientation to said ring, said pyramidal protuberances having apexes, said apexes fitting snugly within the opening within said flange of said liner, said protuberances providing friction and mechanical resistance to downward movement of said piece of shelving material along said vertical rigid cylindrical support.

11. The display assembly as described in claim 1 in which said wedge retainer comprises an O-ring.

12. A kit for constructing a merchandising display, said kit comprising:

(a) at least one removable display attachment, (i) said removable display attachment comprising a flat member, said member having an upper and lower surface, (ii) said removable display attachment further comprising a tubular segment of a predetermined height and diameter, said tubular segment having an upper edge and a lower edge, said tubular segment comprising a continuous aperture from said upper edge of said tubular segment to said upper surface of said flat member, whereby said tubular segment integrally connects to said flat member, said aperture forming an interior space within said tubular segment, (iii) said tubular segment further comprising a wall with an outer and inner surface, (iv) said tubular segment further comprising a lip, said lip oriented toward said interior space of said tubular segment, said lip contacting an outer surface of said vertical cylindrical support at said upper edge of said tubular segment, said wall of said tubular segment diverging from said lip at an angle of approximately 20 degrees, (b) at least one wedge retainer, (i) said wedge retainer comprising a flexible band, (ii) said band having a triangular cross-section, (c) at least one vertical rigid cylindrical support, (d) at least one piece of shelving material, each said piece of shelving material comprising an upper surface and a lower surface, each said piece of shelving material comprising at least one opening penetrating said lower surface of said piece of shelving material, (e) at least one plastic liner, (i) said liner having an inner and outer surface, said liner having an upper edge and a lower edge, (ii) said liner further comprising a flange, said flange having an upper and lower surface, (iii) said liner further comprising an upwardly protruding cylindrical tubular segment, said tubular segment comprising a lower edge, (iv) said lower edge of said upwardly protruding cylindrical tubular segment integrally attached to said upper surface of said flange, said tubular segment comprising an opening which is contiguous with an opening within said flange and which penetrates said lower surface of said flange, thus comprising one continuous cylindrical opening within said plastic liner.

13. A kit for constructing a merchandising display, said kit comprising:

(a) at least one piece of shelving material, said shelving material further comprising:

(i) a periphery, (ii) an upper surface and a lower surface, (iii) a plurality of openings, each said opening located along the periphery of each said piece of shelving material, each said opening having an inner wall with contours, said wall terminating at said bottom surface, each said opening further comprising a space through which a vertical rigid support can slidably fit, (b) a plurality of retainers comprising plastic liners in subcombination, each said plastic liner comprising:

(i) a flange, said flange having an upper and a lower surface, said flange further comprising an opening penetrating said upper surface of said flange and said lower surface of said flange, (ii) an upwardly protruding tubular cylindrical segment, said segment comprising an upper edge and a bottom edge, said protruding tubular cylindrical segment further comprising an interior cylindrical space contiguous with said opening of said flange, (c) a plurality of wedge retainers, each said wedge retainers comprising a semirigid plastic ring, said ring further comprising pyramidal wedges protruding in an upward orientation from said ring and integrally attached thereto.

* * * * *